US007775073B2

(12) United States Patent
Green

(10) Patent No.: US 7,775,073 B2
(45) Date of Patent: Aug. 17, 2010

(54) LOCK

(75) Inventor: Glyn Green, Willenhall (GB)

(73) Assignee: Henry Squire & Sons Limited (GB)

( * ) Notice: Subject to any disclaimer, the term of this patent is extended or adjusted under 35 U.S.C. 154(b) by 215 days.

(21) Appl. No.: 11/687,751

(22) Filed: Mar. 19, 2007

(65) Prior Publication Data

US 2007/0220929 A1 Sep. 27, 2007

(30) Foreign Application Priority Data

Mar. 21, 2006 (GB) ..... 0605638.6

(51) Int. Cl.
*E05B 37/02* (2006.01)
*E05B 37/00* (2006.01)

(52) U.S. Cl. ..... 70/312; 70/22; 70/286

(58) Field of Classification Search ..... 70/22, 70/24, 25, 30, 233, 286, 312, DIG. 21, DIG. 25, 70/DIG. 44
See application file for complete search history.

(56) References Cited

U.S. PATENT DOCUMENTS

| | | | | |
|---|---|---|---|---|
| 1,924,987 | A | 8/1933 | Furino | |
| 5,653,136 | A | 8/1997 | Huang | |
| 6,386,005 | B1 * | 5/2002 | Kuo | 70/312 |
| 6,415,634 | B2 | 7/2002 | Luquire | |
| 6,422,051 | B1 * | 7/2002 | Kuo | 70/312 |
| 6,711,922 | B1 * | 3/2004 | Tsai | 70/312 |
| 6,799,445 | B1 * | 10/2004 | Tsai | 70/312 |
| 6,799,446 | B1 * | 10/2004 | Tsai | 70/312 |
| 6,845,643 | B2 * | 1/2005 | Tsai | 70/312 |
| 6,880,371 | B2 * | 4/2005 | Huang | 70/312 |
| 7,146,830 | B2 * | 12/2006 | Huang | 70/312 |
| 2002/0104337 | A1 * | 8/2002 | Kuo | 70/312 |
| 2002/0134121 | A1 | 9/2002 | Kuo | |

FOREIGN PATENT DOCUMENTS

| | | |
|---|---|---|
| FR | 544889 | 10/1922 |
| GB | 2229220 | 9/1990 |

OTHER PUBLICATIONS

European Search Report mailed Mar. 19, 2008.

* cited by examiner

*Primary Examiner*—Peter M Cuomo
*Assistant Examiner*—Christopher Boswell
(74) *Attorney, Agent, or Firm*—Andrus, Sceales, Starke & Sawall, LLP

(57) ABSTRACT

An improved locking device, such as a combination padlock, is provided in which the re-coding thereof can be carried out in a convenient and/or efficient manner. The locking device has a body including a plurality of dials disposed to surround a lock member in an axially spaced relationship therealong. Relative axial sliding movement is possible between the dials and the lock member between a locked position and a release position. The lock member has at least one generally radially extending exterior locking configuration received in a corresponding first location at one side of a dial in the locked position, and in a corresponding second location within a dial in the release position. Each dial, in the release position, is angularly movable relative to the locking configuration so as to allow re-coding the dial.

16 Claims, 3 Drawing Sheets

LOCK

Figure 1:
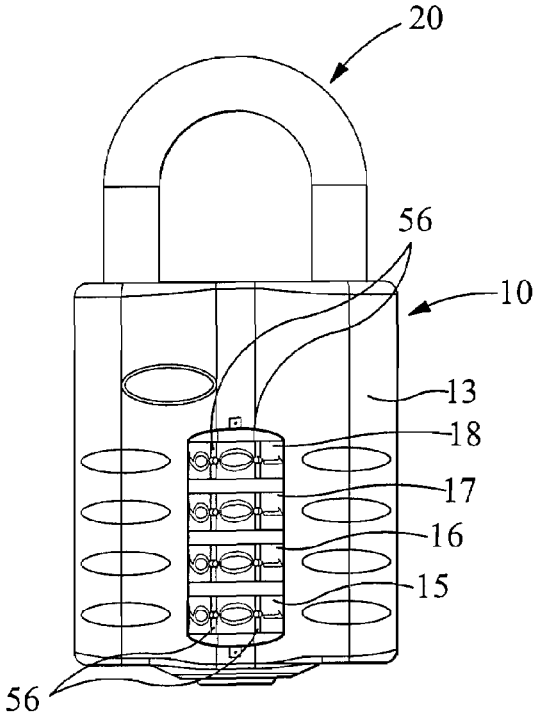

This invention relates to locking means, particularly, but not exclusively, a combination padlock for use in high security applications.

EP1336705 discloses a high security combination padlock in which a slider shaft is axially movable in a lock body between respective locked, unlocked and re-set/recoding positions, the shaft carrying tumblers/clutch wheels, each of which has three angularly spaced locking fins therearound. Respective dials peripherally surround the tumblers/clutch wheels and each dial comprises two distinct inside surfaces. One such surface is formed with 10 slots spaced angularly 36° apart, for receiving the three fins of an associated tumbler/clutch wheel, whilst the other such surface allows the tumbler/clutch wheel to be received in the dial independently rotatably of one another.

In the locked position of the slider shaft of the padlock the tumbler/clutch wheel of each dial is surrounded by the said other such inside surface of the dial. To move the slider shaft axially outwardly to its unlocked position the dials must be moved, if necessary, to define the code of the lock so as to allow the 3 fins on each of the tumblers/clutch wheels to align with 3 fin slots in each of several body extensions between which the dials are disposed. Only with the correct tumbler/clutch wheel alignment relative to the fin slots can the slider shaft be moved from its locked to its unlocked position.

The slider shaft must be axially moved further outwardly from its unlocked position to reach its combination code re-set/re-coding position. In this position the 3 fins of each of the tumbler/clutch wheels are received entirely into the corresponding 3 fin slots in the body extension. This allows the dials to be rotated about the slider shaft independently of the tumblers/clutch wheels, thereby allowing any desired combination code to be selected for opening the padlock.

An object of the invention is to provide locking means, such as a combination padlock, in which the re-coding thereof can be carried out in a more convenient and/or efficient manner.

According to a first aspect of the invention, there is provided locking means comprising a body including a plurality of dials disposed to surround a lock member in an axially spaced relationship therealong, relative axial sliding movement being possible between the dials and the lock member between a locked position and a release position, the lock member having at least one generally radially extending exterior locking configuration, said at least one locking configuration being received in a corresponding at least one first location at one side of a dial in said locked position, and in a corresponding at least one second location within a dial in said release position, each dial, in said release position, being angularly movable relative to said at least one locking configuration so as to allow re-coding the dial.

In one embodiment the lock member is a shaft having a latch pin at a free end thereof for engagement with a shackle, the body being slidable along the shaft such that in the locked position part of the body encompasses the latch pin and engaged shackle to prevent disengagement, whilst in the unlocked position said part of the body is clear of the latch pin to allow such disengagement.

Preferably the locking means is part of a bicycle locking arrangement with the locking means and locking member at one end of a (sleeved) cable and the shackle at the other end, to complete a locking loop in the locked position.

According to a second aspect of the invention there is provided a combination padlock comprising a body in which is slidably arranged a shackle, which is biased to an open position relative to the body and is movable against said bias to a locked position in which it is retained by locking means, an operating member axially movable in the body between a locking position, in which it actuates said locking means to cause the shackle to be held retained thereby in its locked position, and a release position, in which the shackle can release from said locking means and move to its open position, a plurality of dials disposed to surround the operating member in an axially spaced apart relationship therealong, the operating member having at least one generally radially extending exterior locking configuration, said at least one locking configuration being received in a corresponding at least one first location at one side of a dial when the operating member is in its locked position, and in a corresponding at least one second location within a dial when the operating member is in its release position, each dial, when the operating member is in its release position, being angularly movable relative to said at least one locking configuration so as to allow re-coding the dial.

Preferably the at least one locking configuration is a radial projection and the first and second locations are respective release channels formed as slots or grooves.

More preferably the at least one second location is a release channel which is formed in an inner member of a dial assembly, of which said dial is the outer member thereof, a clutch between the inner and outer members allowing the inner and outer member to move angularly together when the operating member is in its locked position, and allowing the outer member to move angularly around the inner member, when the operating member is in its release position.

In one embodiment the clutch is formed by a yieldable member between the inner and outer members. Preferably the yieldable member is of plastics material or of rubber material. Desirably the inner and outer members are of metal.

In another embodiment the clutch is defined between the inner member, which is of metal, and the outer member which is of rubber or plastics material.

Conveniently the operating member is a cylindrical spindle having on its exterior surface a number of sets of said radially extending locking projections, the sets being equally axially spaced along the spindle, and desirably each set comprises three fins arranged at arcuate spaced apart distances, at least one of which is not equal to the other two distances. For example two fins could be spaced from each other by 144° and each from the third fin by 108°. This arrangement is to make the use of known picking techniques difficult with the combination lock of the invention.

The inner member of each dial assembly is formed internally with a form of release channels or slots identical with the fin arrangement of the spindle. Where there is a clutch member between the inner and outer member of the dial assembly, the outer surface of the (metal) inner member is arranged to be keyed to an inner surface of the clutch member, for example by arcuate projections on the inner member being received in corresponding arcuate slots of the clutch member, so that the members rotate together (with the dial) when the operating member is in its locked position, and stay stationary together when the operating member is in its release position and the dial is turned to re-code the lock dials. The inner surface of the (metallic) dial has angularly spaced apart ribs which are received in correspondingly angularly spaced grooves in the deformable outer surface of the clutch member, to provide a positive indication when a re-coded dial number has been reached upon dial rotation.

If no clutch member as such is used, the inner surface of the yieldable material dial is formed with deformable ribs, with the outer surface of the metallic inner member having the grooves, again so that a positive re-coded number is reached upon dial rotation.

Figure 2:
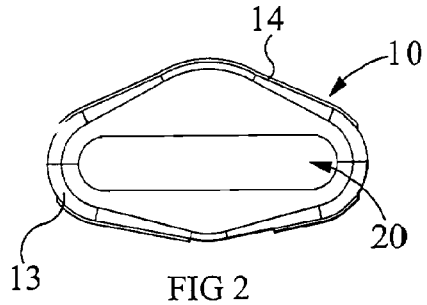
Figure 3:
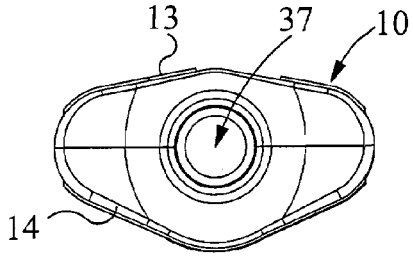
Figure 4:
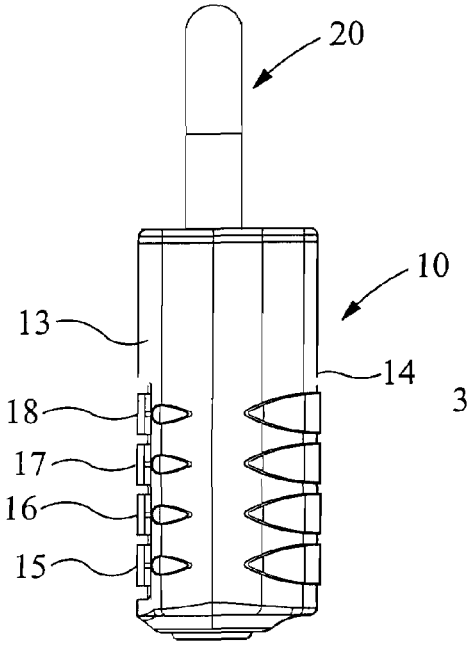
Figure 5:
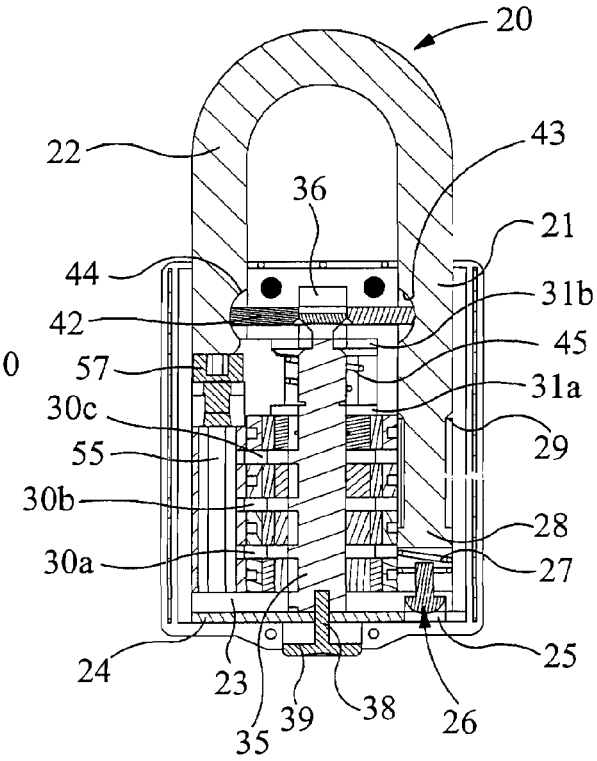
Figure 6:
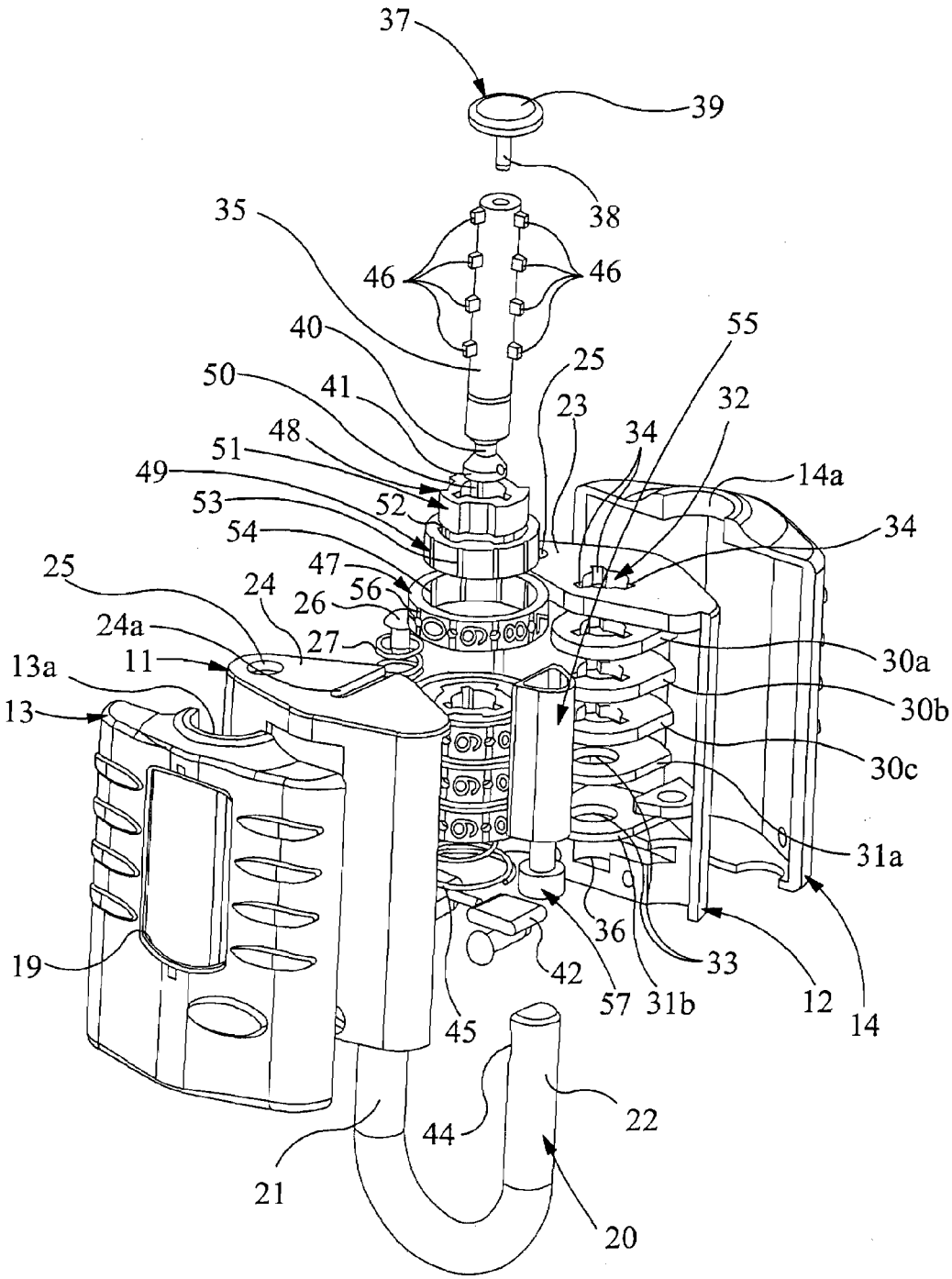
Figure 7:
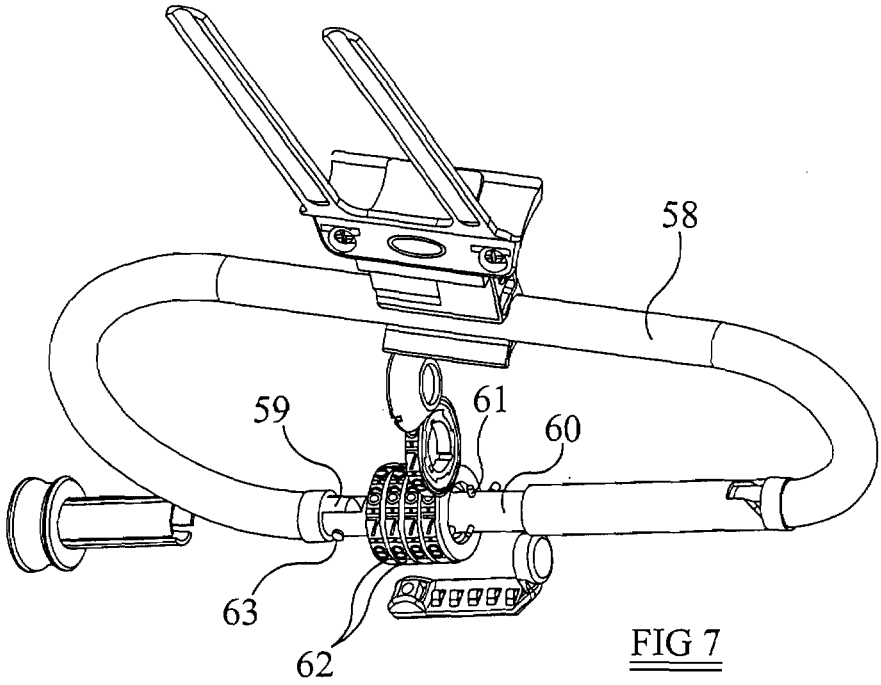
Figure 8:
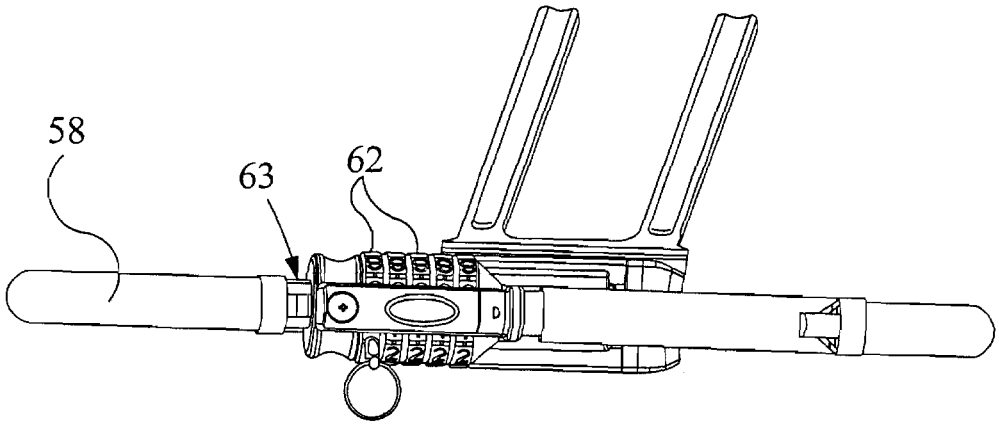

The invention will now be described, by way of example, with reference to the accompanying drawings, in which:

FIG. 1 is a front view of a combination padlock of the invention, in its locked state, FIGS. 2 to 4 are respectively a top plan view, an underneath plan view and a side view of the padlock of FIG. 1, FIG. 5 is a longitudinal internal sectional view of the padlock of FIGS. 1 to 4, FIG. 6 is an exploded perspective view of the padlock of FIGS. 1 to 5, FIG. 7 is an exploded perspective view of a cycle lock of the invention, and FIG. 8 is a side view of the cycle lock in its assembled state.

The combination padlock 10 shown in FIGS. 1 to 6 of the drawings comprises a body made up of two inter-engaging sides, namely a body cover side 11 and a body gate side 12. These two sides 11, 12 can be made of any suitable material, for example plastics material, but they could be made of metal if required. This body is of conventional combination padlock form which is repeated by way of an outer cover of the padlock, this being formed of two inter-engaging cover parts, namely a front cover 13 and a rear cover 14. As will be apparent from the description hereinbelow, the body cover side 11 is provided with a central longitudinal aperture divided into four sections through which protrude four dial assemblies 15 to 18 respectively, these dial assemblies also partly projecting through a corresponding centrally disposed rectangular aperture 19 in front cover 13, so that in the normal way a user can rotate the dial assemblies, as will be described, to bring them to position where the combination code is correct, allowing opening of the padlock. The front and rear covers would normally, like the body cover sides, be of a rigid plastics material, but they could be metallic if required.

Mounted partly within the body is a shackle 20 which is of conventional form, namely it is of U-shape, with one of the arms of the U being extended. This longer arm is denoted by the numeral 21, with the shorter arm being denoted by the numeral 22. FIG. 5 shows a locked state of the padlock, in which the shackle is in its innermost position relative to the body of the padlock. As can be seen, in this state, the extremity of the shorter arm 22 is received within the body. However when the padlock is unlocked, this extremity is clear of the body to allow the padlock to be inserted around a suitable article in the normal manner. Again in the normal manner, it will be understood that the extremity of the longer arm 21 is always received within the body, whether the padlock is in its locked or released state. As can be seen from FIG. 5, this longer arm 21 is slidable, and when the padlock is unlocked, rotatable, within a generally circular-section enclosure defined between the two sides of the body. The body gate side 12 terminates at a bottom plate 23, whilst the body cover side 11 terminates at a thinner bottom plate 24 which fits against the outside of the bottom plate 23. As shown best in FIG. 6, a stepped circular aperture 25 extends through the plates 23 and 24 to receive a rivet 26, the stem of which extends into the enclosure in which the longer arm 21 of the shackle 20 is received. As shown in FIGS. 5 and 6, a coiled compression spring 27 is received about this rivet stem, engaging at one end against the plate 23 and engaging at its other, upper end against the extremity of the longer arm 21 of the shackle so as to bias the shackle 20 in a direction out of the top of the body of the padlock. This extremity of the longer arm 21 is formed as a head 28 for engagement with a projection 29 in the enclosure in order to prevent removal of the shackle from the body in the unlocked position of the padlock. It will be understood that the upper end of the body and also the upper end of the cover of the padlock are each configured to receive therethrough passage of the two arms of the shackle 20 in the normal manner, the upper end of the padlock, however, otherwise being closed.

As best seen in FIG. 6, the interior surface of the body gate side 12 is formed with a number of centrally arranged, upstanding, parallel, aligned, but spaced apart, dividers which extend into the body cover side 11 and engage or substantially engage the inner surface thereof, so that these dividers extend substantially across the whole of the interior of the body at the inner centre thereof. In the embodiment illustrated, there is a first series of dividers 30*a*, 30*b* and 30*c*, and a second set of dividers 31*a* and 31*b*. The divider 30*a* is nearest the bottom plate 23 of the body gate side 12, whilst divider 31*a* follows divider 30*c*, with divider 31*b* being disposed substantially midway between 31*a* and the closed end part of the upper end of the padlock body.

The bottom plate 23 and the first set of dividers are respectively provided therein with aligned, identical configurated apertures 32, while the dividers 31*a*, 31*b* are provided with respective aligned identical circular openings 33 therethrough, the apertures 32 and openings 33 being coaxial and the apertures 32 effectively comprising a central circular opening identical to the openings 33 but with three angularly spaced generally radial slots 34 extending outwardly from the circular aperture.

The angular spacing of the radial slots is not uniform, in that at least one of the spacings is not identical to the other two angular spacings. In a preferred embodiment two of the slots could be spaced from each other by 144° and each from the third radial slot by 108°. However other suitable angularly spaced distances could be selected and indeed it would be possible to have all three angular distances separate and distinct from each other.

At its lower end adjacent plate 24, the padlock outer cover has a central circular opening formed by respecting matching semi-circular openings 13*a*, 14*a*. Moreover an aligned slot 24*a* is provided in plate 24.

Received through the apertures 32 and openings 33 is an axially slidable operating member in the form of a spindle 35. This spindle has a generally cylindrical external surface and has a length such that, as shown in FIG. 5, in the locked state of the padlock, its one end abuts the internal surface of the bottom plate 23 whilst its upper end terminates just short of a recess 36 in the closed upper end of the padlock. In this state, it can be seen that a push button 37 having a central stem 38 fixed in the lower end of the spindle 35 has its manually operable head part 39 spaced away from the outer surface of the bottom plate 24, with its stem 38 extending through the central opening in the cover and also through the slot 24*a* in said plate 24 so that it can be received in the spindle 35 as shown. Moreover it will be understood that the lower end of the spindle at which the push button 37 is fitted is received in the aperture 32 in the bottom plate 23, as will be described. The head part 39 is slidably received in the central circular opening of the outer cover of the padlock.

At its inner, upper end, received within the interior of the padlock body, the spindle is formed with an annular groove 40 with sloping walls at either side of the groove leading thereto, the upper end of the spindle at said one side of the groove being formed as a short cylindrical head 41.

At the position substantially where this head is disposed in the locked position of the padlock shown in FIG. 5, there is disposed, at opposite sides of the spindle head a bolt 42, which in this locked state of the padlock is parted by the head 41 so that it engages in oppositely facing grooves 43, 44 respectively in the longer and shorter arms 21, 22 of the shackle 20. As shown in FIGS. 5 and 6, the end of the head 41 of the spindle can be provided with a circlip and a spindle pin. Finally in relation to the locking and unlocking action of the spindle 35, it will be noted best from FIG. 5 that the spindle is spring loaded to its locked state shown in FIG. 5 by virtue of a coiled compression spring 45, the upper end of which bears against the divider 31*b*, and the lower end of which is connected to a groove in the spindle 35 which, in the locked state of the padlock, is disposed just at the upper side of the divider 31*a*. Accordingly when the head part 39 of the push button 37 is pushed inwardly by a user, with, as will be described, the dial assemblies in the correct coded positions, the spindle 35 will slide axially within the body of the padlock so as to compress the spring 45, so that when pressure on the spindle is released, it is biased automatically to return to its FIG. 5 state.

Accordingly from the above it will be understood that as shown in FIG. 5, the padlock is in its locked state when the shackle 20 has the extremity of its shorter arm received within the body, as shown, with the spindle 35 being biased to its outer position by means of the spring 45, so that the head part 39 of the push button is spaced outwardly of engagement with the outer surface of the bottom plate 24, as shown. In this position the head 41 of the spindle, together with associated circlip and spindle pin, force the bolt 42 to the position shown where the bolt engages in the respective grooves 43, 44 of the longer and shorter arms 21, 22 of the shackle. Accordingly this bolt prevents movement of the shackle, in particular sliding movement of the longer arm 21, to release the extremity of the shorter arm 22 from the casing. It will also be understood, as will be described below, that as with a normal padlock, if the dial assemblies are not in the correct positions corresponding to the release code, it will not be possible to push in the spindle 35 by means of the head part 39 of the push button 37 in order to release the locking means, in the form of the bolt 42, and thereby release the shackle by virtue of its automatic outward movement under the force of the spring 27.

As can be seen best from FIG. 6, the exterior surface of the spindle 35 is formed with four axially spaced apart sets of radial locking fins 46, the first of the four sets being at the lower end of the spindle 35 so that, as will be described, the fins of this first set are received in the radial slots 34 of the configurated aperture 32 in the bottom plate 23 of the body gate side 12 when the padlock is in its locked state as shown in FIG. 5. The spacing of the sets of locking fins axially along the spindle are such as to correspond to the respective spacings apart of the dividers, so that, as can be seen from FIG. 5, with the padlock in its locked state, the remaining three sets of radial locking fins are received in the remaining three configurated apertures in the first set of dividers 30*a*, 30*b* and 30*c*.

From the above it will be understood that for each of the four sets of radial locking fins 46, the fins are at the same axial position but are spaced angularly around the exterior surface of the spindle, this angular spacing corresponding exactly to the angular spacing of the slots 34 in the plate 23 and the first set of dividers. In other words, with the preferred embodiment referred to, two fins in each of the set of fins are angularly spaced apart by 144°, whilst each of these fins is itself spaced from the remaining fin by an angle of 108°. Accordingly in the locked state of the padlock shown in FIG. 5, the locking fins in the first of the four sets are received in the slots 34 in the aperture 32 in the bottom plate 23, whilst the fins in the next three sets are respectively received in the slots 34 in the respective apertures 32 of the first, second and third dividers in the first set of dividers 30*a*, 30*b* and 30*c*.

As can be seen from FIGS. 5 and 6, the dial assemblies 15 to 18 respectively, referred to above, are fitted in the respective spaces defined between the bottom plate 23, the first set of dividers and the first divider 31*a* of the second set of dividers, the four spaces defined by the axial spacing apart of these members receiving the four dial assemblies shown in this embodiment of the invention, i.e. as shown in FIG. 5. It will also be appreciated from FIG. 5 that the dials are arranged to surround the spindle 35 which, as will thus be explained, passes through the centre of each dial assembly, being co-axial therewith.

Each dial assembly is identical, and one such assembly will be described in relation principally to FIG. 6 for the dial assembly 15 which is disposed between the interior surface of the bottom plate 23 and one side of the divider 30*a*. Each dial assembly is made up of three parts, namely an outer metallic digit wheel 47, an innermost metallic digit wheel clutch 48, and a plastics or rubber material clutch 49 filling the space between the digit wheel 47 and the digit wheel clutch 48.

As shown in FIG. 6, the metal digit wheel clutch 48 has a central opening 50 therethrough which is of a shape and size exactly to match each of the configurated apertures 32 of the plate 23 and first set of dividers, so that, as will be described in detail, the fins 46 can move from their locked position shown in FIG. 5 into the respective openings 50 in the digit wheel clutches 48 of the four dial assemblies when the push button 37 is depressed and the spindle 35 moves to open the padlock, when the dial assemblies are in their correct coded relationship at the aperture 19 as, for example, shown in FIG. 1 for the code 0000.

The exterior of the digit wheel clutch 48 is formed with three angularly spaced apart lobes 51 corresponding to the angular spacings of, and being aligned with, the slots of the opening 50 through the digit wheel clutch 48. These lobes 51 are closely received in correspondingly shaped grooves 52 angularly spaced around the interior of a central opening through the clutch 49, the opening 50 and the opening through the clutch being co-axial with the central axis of the spindle 35. Accordingly the digit wheel clutch 48 is keyed to the clutch 49 so that these two components always rotate together. It will thus be understood that when the slots in the opening 50 in the digit wheel clutch 48 receive radial fins of the spindle therein, the digit wheel clutch 48 and clutch 49 are prevented from rotation, given that the spindle 35 itself cannot rotate.

The exterior surface of the clutch 49 is provided with grooves 53 arranged equi-angularly spaced therearound, each groove extending across the axial extent of the exterior surface of the clutch 49 and being parallel to the central axis of the clutch. The interior surface of the circular digit wheel 47 is similarly provided with ten cross-wise extending equi-angularly spaced apart shallow ribs 54 which, as will be explained during normal rotation of the dial assemblies, are received in the shallow grooves 53 thereby keying together the clutch 49 and the metal digit wheel 47.

Accordingly considering the locked state of the padlock shown in FIG. 5, it will now be appreciated that the four sets of radial locking fins 46 are at the axial positions of the bottom plate 23 and the three dividers of the first set of dividers 30*a*, 30*b* and 30*c*. Accordingly in this locked state, there are no locking fins in the four dial assemblies so that these assemblies are free to rotate about the spindle 35, rotation of the digit wheel 47 by a user also causing corresponding rotation of the clutch 49 and wheel clutch 48 given that at this time the clutch 49 is keyed to the digit wheel 47 and the digit wheel clutch 48 is, as always, keyed to the clutch 49. Thus it is possible for an operator to rotate each of the four digit wheels 47 to bring it to the correct coding position for opening the combination padlock. Clearly if an attempt is made to open the padlock with any one of the digit wheels in an incorrect coded position, it will not be possible to effect opening in that it will not be possible to push the spindle 35 inwards from its FIG. 5 position in that at least one of the sets of radial locking fins 46 will not be aligned with the corresponding slots in the digit wheel clutch 48 of the dial assembly in question. Only when the wheel 47 is in its correct coded position will the slots in the digit wheel clutch 48 of that dial assembly be correctly aligned with the three radial locking fins of the spindle 35 which are arranged adjacent to the dial assembly in question and can thus move into the slots in the digit wheel clutch 48.

Accordingly assuming that all the digit wheels are in their correct positions, it is then possible for an operator to push the button 37 inwards, whereupon the spindle 35 will slide upwardly, as viewed in FIG. 5, with the four sets of radial locking fins 46 moving into the corresponding slots in the four openings 50 in the four digit wheel clutches 48 of the four dial assemblies. As described above, this sliding movement of the spindle 35 releases the bolt 42 so that the spring loaded shackle is moved clear of the body, so that the padlock is now in its open state. In this state, the shackle can be rotated by way of its longer arm 21 about the central axis of the enclosure in which said longer arm 21 is slidable. If force on the button is released whilst the lock is open, the spring 45 will return the spindle to its locked position, and the bolt 42 will extend. Accordingly in order thereafter to close the padlock, the button will need to be depressed inwardly again.

With the padlock in its open position, i.e. with all the radial locking fins 46 within the four dial assemblies, the digit wheel clutch 48 and clutch 49 of each dial assembly cannot rotate in that they are keyed to the spindle 35 by way of the radial locking fins 46 on said spindle. However in this state it is possible to re-code each dial assembly by rotating the digit wheel 47 relative to the fixed clutch 49 and digit wheel clutch 48 which the digit wheel surrounds. This is due to the provision of the plastics or rubber material clutch and the inter-engagement of the shallow grooves and ribs referred to above. Accordingly a user can rotate the digit wheel 47 so that the ribs move out of the grooves 53 in which they have previously been set and this rotation takes place until the required digit is then visible at the aperture 19 in the front cover 13. Accordingly as shown in FIG. 1 it is assumed that the correct coding for opening the lock is with the four digit wheels 47 at 0000. However if it is wished to change this code, it would be possible, with the lock open, to rotate the digit wheel of, for example, the dial assembly 15 so that a different digit is aligned with the three zeros of the other three dial assemblies 16 to 18, this being accomplished, as described, by rotating the digit wheel 47 of the dial assembly 15 relative to its associated fixed clutch 49 and digit wheel clutch 48. When the correct new position is reached, the ribs 54 on the inside surface of the digit wheel 47 will be received in respective shallow grooves 53 of the exterior surface of the clutch 49, so that when the spindle is moved back to its locked position as shown in FIG. 5, the adjusted digit wheel 47 will again now be keyed to the clutch 49 by virtue of the engagement of the engagement of the ribs 54 on the digit wheel 47 with the groove 53 of the exterior of the clutch. As explained, once the spindle has returned to its locked position shown in FIG. 5, rotation of the digit wheel 47 will no longer take place with the digit wheel clutch 48 and clutch 49 fixed, but will take place along with corresponding rotation of those two components, which are now free to rotate, in that the radial locking fins have moved out of the digit wheel clutch 48.

Accordingly re-coding of the padlock can take place very simply when the lock is in its open position and there is no need for a further adjustment provision to be provided beyond the open and closed positions of the operating member, in the form of the spindle 35. The provision of the clutch 49 inside the adjustable digit wheel is particularly convenient and effective.

In the embodiment of the invention shown, a ratchet spring 55 is disposed in the body at one side of the four digit wheels 47, this being formed with a longitudinal rib or ribs to cooperate with respective shallow cross-grooves 56 between each of the digits on a digit wheel 47. By way of this arrangement, each digit wheel is thus held in position, for example when adjusted as in FIG. 1, thereby ensuring that there must be a positive force applied to the wheel to rotate it freely in the locked state of the padlock shown in FIG. 5 and, indeed, also during recoding in the unlocked state of the padlock. A cap screw 57 extending from one end of the ratchet spring 55 can be used as a stop against which the extremity of the shorter arm 22 engages, as shown in FIG. 5, in the locked state of the padlock.

As described above, the clutch 49 is a separate member from the digit wheel clutch 48 and the clutch is formed, in effect, by providing a yieldable member between the inner and outer members of the dial assembly. However in an alternative embodiment, the digit wheel clutch and the clutch component could be combined into a single integral component, made of metal, with the digit wheel being of yieldable material, such as plastics or rubber, so that it is tactile. In either embodiment each digit wheel may be provided with some form of peg or Tommy Bar arrangement to enable an operator to apply the necessary leverage to effect the rotation required around the fixed digit wheel clutch and clutch assembly.

The padlock of the invention is particularly effective in operation and has the advantage of ease of manufacture and associated reduction of manufacturing costs. Moreover it is aesthetically pleasing and can be made in various colour combinations due to the use of the plastics cover and/or body referred to.

The inventive locking means formed by the arrangement of dials, each formed of an outer digit wheel, a clutch and an inner digit wheel clutch, disposed around a spindle or shaft having locking pins, can be applied to various locking devices other than a combination padlock. For example FIGS. 7 and 8 show the locking means incorporated into a bicycle lock, whilst application to a door lock is also possible.

The bicycle lock shown in FIGS. 7 and 8 includes a steel cable in a plastics sleeve 58. One end of the sleeve is formed with a pivotable lock shackle 59 in the form of a fork, whilst the other end of the sleeve is formed with a lock member in the form of an extended spindle or shaft 60 which is equivalent to the operating member 35 of the first embodiment, in having five axially spaced apart sets of radial locking pins 61 for co-operation with the five dial assemblies 62 shown. An end of the shaft 60 has a cross-pin 63 for engagement by the shackle 59 as shown best in FIG. 7 to complete the 'loop' of the bicycle lock in a normal manner.

The body of the locking means comprises said five dial assemblies 62, directly equivalent to the four dial assemblies of the first embodiment, for co-operation with the locking pins 61 of the shaft 60, in exactly the same manner as for the first embodiment. The only difference is that the shaft is stationary and the body is slidably movable over it, rather than the opposite way round, as in the first embodiment. In the release/unlocked position of FIGS. 7 and 8 the shackle 59 can be released from the cross-pin 63. However as the dial assemblies are in the correct coded positions of the lock, it is possible to slide the body, including the dial assemblies, along the shaft, to the left as viewed in the drawings, so that the pins move out of the dial assemblies. This brings an end of the body around the shackle and cross-pin, which are thereby encompassed by said body end, thereby preventing release of the shackle. In this locked state, the dial assemblies can be rotated out of their correct code, so that unlocking can then only take place if the dial assemblies are each moved back to their correctly coded position, allowing sliding of the body along the shaft, to the right, to the release position of FIGS. 7 and 8 where the shackle can again be released. As with the first embodiment, recoding of one or more of the outer digit wheels can be effected in the unlocked state of the bicycle lock by angularly moving a selected outer digit wheel relative to the stationary clutch and inner digit wheel clutch of the outer digit wheel's dial assembly.

The invention claimed is:

1. A locking means comprising a body including a plurality of dials disposed to surround a lock member in an axially spaced relationship therealong, relative axial sliding movement being possible between the dials and the lock member between a locked position and a release position, the lock member having at least one generally radially extending exterior locking configuration, said at least one locking configuration being received in a corresponding at least one first location within a divider provided to one axial side of a dial in said locked position, and in a corresponding at least one second location within a dial in said release position, each dial, in said release position, being angularly movable relative to said at least one locking configuration by provision of an annular clutch therebetween which is provided in the form of a yieldable member of plastics or rubber material which deforms when the dial is rotated relative to the yieldable member which the dial continuously and entirely surrounds so as to allow re-coding the dial, recoding of the dial being possible when the dial is in the release position without the need for further adjustment of the dial beyond the locked and release positions, wherein the clutch remains in the same axial position when recoding.

2. A locking means according to claim 1 wherein the lock member is a shaft having a latch pin at a free end thereof for engagement with a shackle, the body being slidable along the shaft such that in the locked position part of the body encompasses the latch pin and engaged shackle to prevent disengagement, whilst in the unlocked position said part of the body is clear of the latch pin to allow such disengagement.

3. A locking means according to claim 2, wherein the locking means is part of a bicycle locking arrangement with the locking means and locking member at one end of a cable and the shackle at the other end, to complete a locking loop in the locked position.

4. A combination padlock comprising a body in which is slidably arranged a shackle, which is biased to an open position relative to the body and is movable against said bias to a locked position in which it is retained by locking means, an operating member axially movable in the body between a locking position, in which it actuates said locking means to cause the shackle to be held retained thereby in its locked position, and a release position, in which the shackle can release from said locking means and move to its open position, a plurality of dials disposed to surround the operating member in an axially spaced apart relationship therealong, the operating member having at least one generally radially extending exterior locking configuration, said at least one locking configuration being received in a corresponding at least one first location within a divider provided to one axial side of a dial when the operating member is in its locked position, and in a corresponding at least one second location within a dial when the operating member is in its release position, each dial, when the operating member is in its release position, being angularly movable relative to said at least one locking configuration by provision of an annular clutch therebetween which is provided in the form of a yieldable member of plastics or rubber material which deforms when the dial is rotated relative to the yieldable member which the dial continuously and entirely surrounds so as to allow re-coding the dial, recoding of the dial being possible when the dial is in the release position without the need for further adjustment of the dial beyond the locked and release positions, wherein the clutch remains in the same axial position when recoding.

5. A combination padlock according to claim 4, wherein the at least one locking configuration is a radial projecting and the first and second locations are respective release channels formed as slots or grooves.

6. A combination padlock according to claim 5, wherein the at least one second location is a release channel which is formed in an inner member of a dial assembly, of which said dial is the outer member thereof, the annular clutch between the inner and outer members allowing the inner and outer member to move angularly together when the operating member is in its locked position, and allowing the outer member to move angularly around the inner member, when the operating member is in its release position.

7. A combination padlock according to claim 6, wherein the inner and outer members are of metal.

8. A combination padlock according to claim 6, wherein the annular clutch is defined between the inner member, which is of metal, and the outer member which is of rubber or plastics material.

9. A combination padlock according to claim 6, wherein the outer surface of the inner member is arranged to be keyed to an inner surface of the annular clutch so that the inner member and the annular clutch rotate together with the dial when the operating member is in its locked position, and stay stationary together when the operating member is in its release position and the dial is turned to re-code the lock dials.

10. A combination padlock according to claim 9, wherein the inner member is arranged to be keyed to an inner surface of the annular clutch by arcuate projections on the inner member being received in corresponding arcuate slots of the annular clutch.

11. A combination padlock according to claim 6, wherein the inner surface of the dial has angularly spaced apart ribs which are received in correspondingly angularly spaced grooves in a deformable outer surface of the annular clutch, to provide a positive indication when a re-coded dial number has been reached upon dial rotation.

12. A combination padlock according to claim 5, wherein the operating member is a cylindrical spindle having on its exterior surface a number of sets of said radially extending locking projections, the sets being equally axially spaced along the spindle, and desirably each set comprises three fins arranged at arcuate spaced apart distances, at least one of which is not equal to the other two distances.

13. A combination padlock according to claim 12, wherein two fins are spaced from each other by 144° and each from the third fin by 108°.

14. A combination padlock according to claim 12, wherein an inner member of a dial assembly, of which said dial is the outer member thereof, is formed internally with a form of release channels or slots identical with the fin arrangement of the spindle.

15. A locking means comprising a body including a plurality of dials disposed to surround a lock member in an axially spaced relationship therealong, relative axial sliding movement being possible between the dials and the lock member between a locked position and a release position, the lock member having at least one generally radially extending exterior locking configuration, said at least one locking configuration being received in a corresponding at least one first location within a divider provided to one axial side of a dial in said locked position, and in a corresponding at least one second location within a dial in said release position, each dial, in said release position, being angularly movable relative to said at least one locking configuration by provision of an annular clutch therebetween which is provided in the form of a yieldable member of plastics or rubber material which deforms when the dial is rotated relative to said at least one locking configuration so as to allow recoding the dial, recoding being possible when the dial is in the release position without the need for further adjustment of the dial beyond the locked and release positions, wherein the clutch remains in the same axial position when recoding.

16. A combination padlock comprising a body in which is slidably arranged a shackle, which is biased to an open position relative to the body and is movable against said bias to a locking position in which it is retained by locking means, an operating member axially movable in the body between a locking position, in which it actuates said locking means to cause the shackle to be held retained thereby in its locked position, and a release position, in which the shackle can release from said locking means and move to its open position, a plurality of dials disposed to surround the operating member in an axially spaced apart relationship therealong, the operating member having at least one generally radially extending exterior locking configuration, said at least one locking configuration being received in a corresponding at least one first location within a divider provided to one axial side of a dial when the operating member is in its locked position, and in a corresponding at least one second location within a dial when the operating member is in its release position, characterized by each dial, when the operating member is in its release position, being angularly movable relative to said at least one locking configuration by provision of an annular clutch therebetween which is provided in the form of a yieldable member of plastics or rubber material which deforms when the dial is rotated relative to said at least one locking configuration so as to allow recoding the dial, recoding of the dial being possible when the dial is in the release position within the need for further adjustment of the dial beyond the locked and release positions, wherein the clutch remains in the same axial position when recoding.

* * * * *